US005737675A

United States Patent [19]

Okada et al.

[11] Patent Number: 5,737,675

[45] Date of Patent: Apr. 7, 1998

[54] TONER SUPPLY DEVICE INCLUDING TONER CARTRIDGE AND GUIDE

[75] Inventors: Mitsuharu Okada; Toshinori Nishimura; Hiroaki Ohashi, all of Osaka, Japan

[73] Assignee: Mita Industrial Co. Ltd., Osaka, Japan

[21] Appl. No.: 685,016

[22] Filed: Jul. 22, 1996

[30] Foreign Application Priority Data

Jul. 31, 1995 [JP] Japan ..... 7-195509
Jul. 31, 1995 [JP] Japan ..... 7-195510
Jul. 31, 1995 [JP] Japan ..... 7-195511

[51] Int. Cl.[6] ..... G03G 15/08

[52] U.S. Cl. ..... 399/258; 399/262

[58] Field of Search ..... 399/106, 262, 399/258; 222/DIG. 1

[56] References Cited

U.S. PATENT DOCUMENTS 4,972,887 11/1990 Hacknauer et al. ..... 141/346
4,977,429 12/1990 Tani et al. ..... 399/27
5,091,750 2/1992 Yoshida et al. ..... 399/106
5,329,340 7/1994 Fukuchi et al. ..... 399/254
5,383,502 1/1995 Fisk et al. ..... 141/364
5,472,026 12/1995 Herbst et al. ..... 141/383

FOREIGN PATENT DOCUMENTS 6-75473 3/1994 Japan .

*Primary Examiner*—Robert Beatty
*Attorney, Agent, or Firm*—Beveridge, DeGrandi, Weilacher & Young, L.L.P.

[57] ABSTRACT

A toner supply device in which a toner cartridge can smoothly be inserted and removed. The toner supply device includes a toner supply device main body capable of removably setting the toner cartridge to a setting position. The toner supply device main body includes a guide tray for guiding the toner cartridge along an insertion direction when the toner cartridge is inserted to and pulled out from the setting position. Thus, the toner cartridge can smoothly be inserted and removed. The guide tray can assume a guide posture for guiding the insertion and removal of the toner cartridge, and a retreat posture where the guide tray is being retreated to a retreat position. Various engagement members on the guide tray secure or release the toner cartridge to or from the guide tray.

21 Claims, 15 Drawing Sheets

TONER SUPPLY DEVICE INCLUDING TONER CARTRIDGE AND GUIDE

BACKGROUND OF THE INVENTION

1. Field of the Invention

The present invention relates to a toner supply device for supplying toner to the developing device of an image forming apparatus such as an electrostatic copying apparatus, a facsimile or the like, and also to a toner cartridge used in the toner supply device.

2. Description of Related Art

Generally, a toner cartridge is provided in the bottom thereof with a toner falling opening and incorporates a housing case in which toner is housed. A sheet-like seal member as removably attached to the underside of the housing case, closes the toner falling opening.

Such a toner cartridge is inserted into the main body of an image forming apparatus and set to a housing recess therein, and the seal member is then stripped off. This causes the toner falling opening to be opened such that the toner in the housing case falls down and is supplied to the developing device disposed under the housing case.

When the toner in the developing device has fully been consumed, the used toner cartridge is pulled out from the housing recess. Then, a new toner cartridge is inserted and set to the housing recess. Thus, the used toner cartridge can be replaced with a new one.

According to the arrangement above-mentioned, however, when inserting or removing the toner cartridge, it may take much time to replace the toner cartridge due to its twisting or the like.

Further, there remains, in the housing case of the used toner cartridge, a small amount of toner including toner stuck to the seal member. This presents the problem that, when removing the used toner cartridge from the housing recess, such remaining toner falls through the toner falling opening and scatters inside and/or outside of the main body of the image forming apparatus.

In this connection, there is proposed a toner cartridge arranged such that its toner falling opening can be closed by a plate-like shutter member before the used toner cartridge is pulled out. More specifically, when pulling out the used toner cartridge, the plate-like shutter member is inserted into the housing recess in the main body of the image forming apparatus along the underside of the toner cartridge so that the shutter member is mounted on the toner cartridge at its predetermined position. Then, the toner cartridge is pulled out with the toner falling opening closed by the shutter member thus mounted.

However, there are instances where such a toner cartridge is pulled out without the shutter member properly mounted on the toner cartridge at its predetermined position or without the toner falling opening properly closed. This results in scattering of toner remaining in the toner cartridge.

Further, when pulling such a toner cartridge, the shutter member is required to be held as supported by hand until the shutter member is perfectly mounted on the toner cartridge. This disadvantageously lowers the maneuverability of replacement of such a toner cartridge.

Further, while not being used, the shutter member is removed as fully separated from the toner cartridge, and is stored in another place. Accordingly, there are instances where the shutter member cannot be found or it takes much time to search for the shutter member when the shutter member becomes actually necessary for removing the toner cartridge. Further, when mounting the removed shutter member on the toner cartridge, it is required to properly position the shutter member with respect to the toner cartridge. Such positioning is troublesome. Thus, replacing the toner cartridge disadvantageously takes labor.

It would be considered that the last-mentioned problem can be solved by using, for example, the arrangement disclosed by Japanese Patent Laid-Open Publication (KOKAI) No. 6-75473. This publication discloses the arrangement in which the main body of a toner cartridge is made in a double container structure having an inner container and an outer container, in which an elastic and relatively rigid member is used as a shutter member and in which the shutter member is housed in the space between the inner and outer containers when it is not in use.

However, this double container type is complicated in structure. Further, the space for housing the shutter member has to be formed inside of the main body of the toner cartridge. It is therefore expected that the toner cartridge is disadvantageously made in a large size.

SUMMARY OF THE INVENTION

It is a first object of the present invention to provide a toner supply device in which a toner cartridge can smoothly be inserted and removed and can readily be replaced with a new one.

It is a second object of the present invention to provide a small-size toner cartridge having a simple arrangement which can securely prevent toner from scattering at the time of replacement and which can readily be replaced.

It is a third object of the present invention to provide a toner cartridge and a toner supply device each capable of securely preventing toner from scattering when the toner cartridge is replaced.

It is a fourth object of the present invention to provide a toner cartridge and a toner supply device in each of which the shutter member is not required to be held with hand when replacing the toner cartridge, thus providing excellent maneuverability.

A toner supply device according to the present invention comprises a toner supply device main body capable of removably setting a toner cartridge to a predetermined setting position. The toner supply device main body has guide means for guiding a toner cartridge along a predetermined insertion direction when inserting and pulling the toner cartridge into and from the setting position. This enables the toner cartridge to be smoothly inserted and removed.

A toner supply device according to the present invention comprises a guide tray which can assume a guide posture in which the insertion and removal of a toner cartridge are guided, and a retreat posture in which the guide tray is being retreated to a predetermined retreated position. According to the arrangement above-mentioned, the insertion and removal of a toner cartridge can be guided and a long guide stroke is assured as compared with an arrangement in which such insertion and removal are not guided. Thus, the toner cartridge can more smoothly be inserted and removed. Further, when not in use, the guide tray can be retreated and therefore gets out of the way without a large space being occupied.

According to an embodiment of the present invention, the guide tray is rotatable around a predetermined axis and assumes the guide posture and the retreat posture above-mentioned by its rotation around the axis.

Preferably, the guide tray in the retreat posture is engaged with the toner cartridge at its predetermined portion to prevent the toner cartridge as set to the setting position from being pulled out. According to the arrangement above-mentioned, the guide tray in the retreat posture can prevent the toner cartridge from being pulled out. Since the guide tray is required to be operated whenever the toner cartridge is pulled out, the toner cartridge is prevented from being carelessly pulled out, causing toner to scatter. Further, the guide tray for guiding the insertion and removal of the toner cartridge, also serves as a member for preventing the toner cartridge from being pulled out. Thus, the structure can be simplified as compared with an arrangement in which the guide tray and the pulling-out preventing member are individually provided.

Preferably, the guide tray has engaging means arranged to be engaged with the shutter member at a predetermined portion thereof to prevent the shutter member from coming off from the guide tray. In such an arrangement, the shutter member is held by the guide tray and is therefore not required to be supported by hand.

Where the shutter member of the toner cartridge is connected to the toner cartridge main body such that the shutter member at the opening position is rotated around a predetermined axis and retreated to a retreat posture where the shutter member extends along the pulling-side end surface of the toner cartridge main body, provision is preferably made such that the rotational axis of the guide tray is substantially identical with the rotational axis of the shutter member when the toner cartridge is located in the setting position. According to the arrangement above-mentioned, the maneuverability is excellent since both the guide tray and the shutter member can integrally be retreated to the retreat posture. On the other hand, if the toner cartridge is positionally shifted from the setting position, the rotational axes of the guide tray and the shutter member are positionally shifted from each other. Thus, both the toner cartridge and the shutter member cannot integrally be rotated to the retreat posture. It is therefore possible to prevent toner from scattering due to defective mounting of the toner cartridge.

To open the shutter member in the course of setting the toner cartridge, there may be disposed positioning means arranged such that, when the toner cartridge is inserted toward the setting position, the displacement of the shutter member in the insertion direction is regulated to position the shutter member at a predetermined position, and the shutter member is then slid to the opening position with respect to the toner cartridge main body.

A toner supply device according to an embodiment of the present invention comprises disengaging means arranged such that, when the toner cartridge is pulled out from the setting position, the disengaging means releases the engagement of the engaging means after the shutter member has closed the underside of the toner cartridge main body.

According to the arrangement above-mentioned, when pulling the toner cartridge, the shutter member closes the toner falling opening of the toner cartridge before the shutter member is disengaged from the toner supply device main body. This involves no likelihood that toner scatters.

Where the toner cartridge comprises shutter position regulating means for regulating the shutter member to the closing position, the disengaging means is preferably arranged to release the engagement of the engaging means after the shutter member has been regulated to the closing position by the shutter position regulating means. This prevents the shutter member from being carelessly opened.

The shutter member of the toner cartridge may have a first portion and a second portion which are slidable along the underside of the toner cartridge main body and which are relatively rotatably connected to each other. According to such an arrangement, it is preferred that when the shutter member is located in the opening position, the first portion is rotatable with respect to the second portion as disconnected from the toner cartridge main body, and is capable of being retreated in a posture where the first portion extends along the pulling-side end surface of the toner cartridge, while the second portion is connected to the toner cartridge main body.

According to the arrangement above-mentioned, when mounting the toner cartridge on the toner supply device main body, the shutter member is slid to the opening position along the underside of the toner supply device main body. This opens the toner falling opening and disconnects the first portion from the toner cartridge main body. Then, the first portion is rotated with respect to the second portion connected to the toner cartridge main body, causing the first portion to be retreated into a posture (position) where the first portion extends along the pulling-side end surface.

In the case of a conventional shutter member of the type to be perfectly removed from the toner cartridge main body, there are instances where it takes time to search for the removed shutter member when it becomes necessary. Further, to mount the removed shutter member on the toner cartridge main body, it is required to properly position the shutter member with respect to the toner cartridge main body. On the other hand, according to the present invention, the shutter member which is not in use, is being connected to the toner cartridge main body. This eliminates not only the labor of searching for the shutter member when it becomes necessary, but also the operation of positioning the shutter member with respect to the toner cartridge main body. This facilitates the maintenance operation. Further, the shutter member which is not in use, is being retreated to the retreat posture in which the shutter member gets out of the way outside of the toner cartridge main body. Thus, there can be achieved a small-size toner cartridge having a simple structure as compared with a double-container structure of prior art, and the toner cartridge when mounted, does not occupy an unnecessarily large space.

Further, with the first portion of the shutter member retreated, the second portion is slidably connected to the toner cartridge main body along the underside thereof. Accordingly, when the second portion is slid, the first portion is guided, causing the first portion to be readily located along the underside of the toner cartridge main body.

In addition, the first and second portions may be formed of an integrally molded article of resin. Such a structure can considerably be lowered in production cost. Further, the portion which relatively rotatably connects the first and second portions to each other, may readily be produced by reducing, at the time of molding, the thickness thereof as compared with remaining portions of the article.

These and other features, objects and advantages of the present invention will be more fully apparent from the following detailed description set forth below when taken in conjunction with the accompanying drawings.

DESCRIPTION OF THE PREFERRED EMBODIMENTS

General Arrangement

Figure 1:
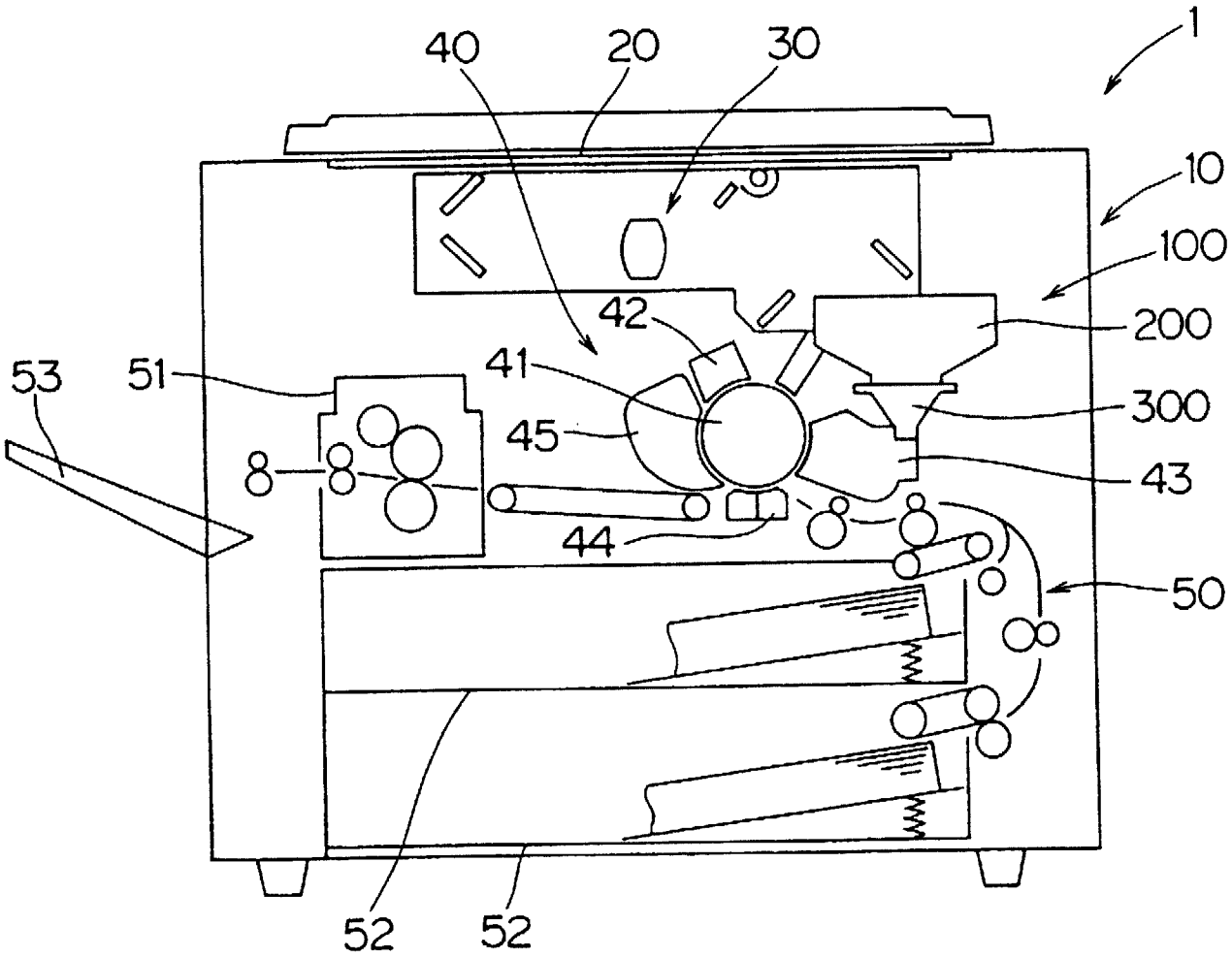
FIG. 1 is a schematic structural view illustrating the inside section of a copying apparatus to which applied is a toner supply device according to an embodiment of the present invention.
Figure 2:
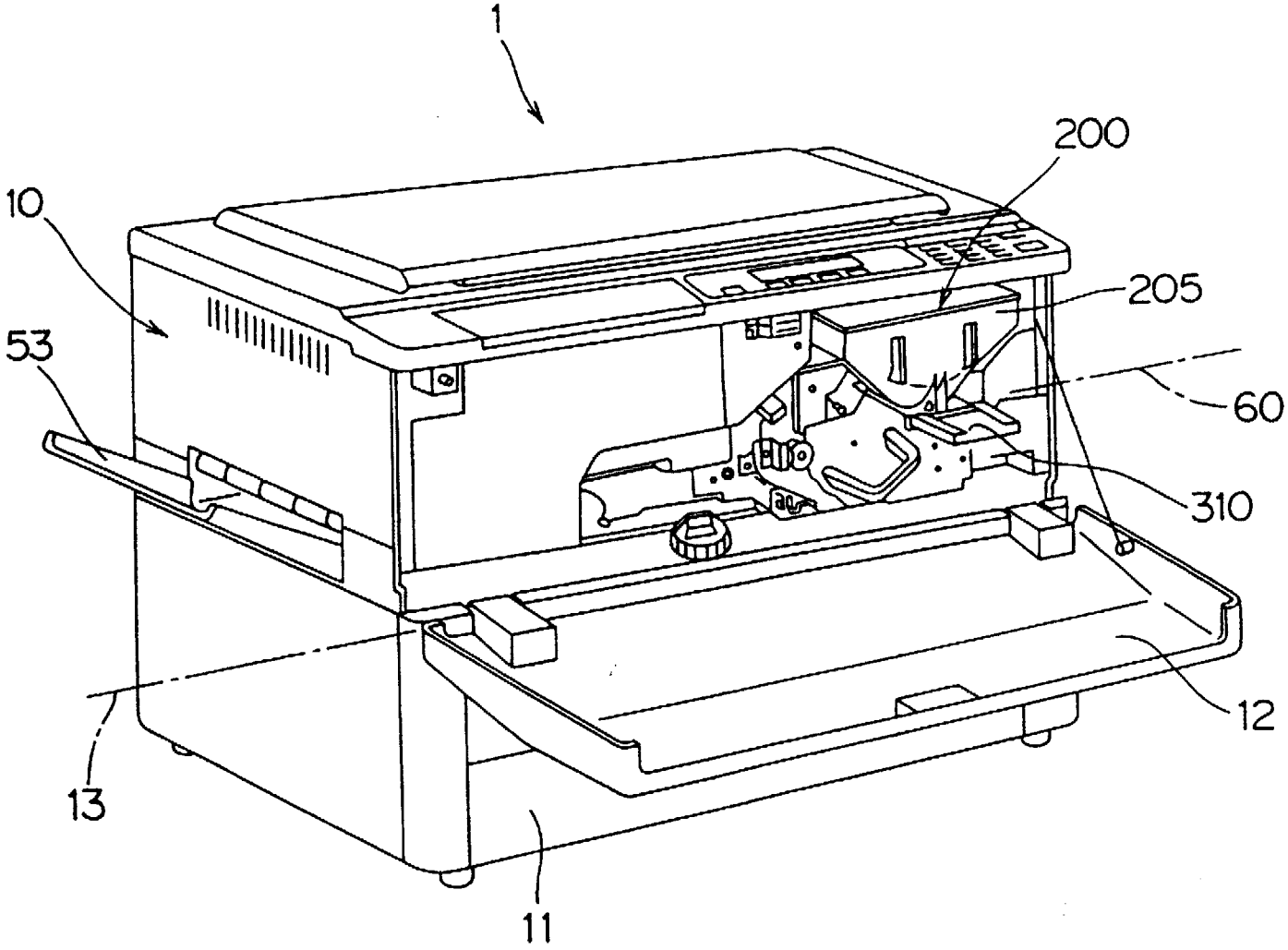
FIG. 2 is a schematic perspective view of the copying apparatus with the front cover opened.

FIG. 1 is a schematic structural view illustrating the inside section of a copying apparatus as an image forming apparatus to which applied is a toner supply device according to an embodiment of the present invention. FIG. 2 is a schematic perspective view of the copying apparatus at the time when a toner cartridge is to be inserted/removed.

With reference to FIG. 1, a copying apparatus 1 incorporates in the main body 10 thereof:

① an optical system 30 which scans a document placed on a transparent document placing plate 20 while the document is being exposed to light, and which introduces the light reflected from the document to a photosensitive drum 41;

② an image forming unit 40 in which an electrostatic latent image formed on the photosensitive drum 41 is converted into a toner image by a developing device 43 and in which the toner image is transferred to a paper sheet; and ③ a paper conveying unit 50 which includes a fixing device 51 for heating and fixing the toner image transferred onto the paper, and which conveys a paper sheet from a paper feed tray 52 to a discharging tray 53 through the image forming unit 40.

In the image forming unit 40, there are disposed, around the photosensitive drum 41, a corona discharger 42, the developing device 43, a transferring corona discharger 44 and a cleaning device 45 in this order. A document image is formed on the outer peripheral surface of the photosensitive drum 41 uniformly electrically charged by the corona discharger 42, thereby to form an electrostatic latent image on the surface of the photosensitive drum 41. This electrostatic latent image is developed into a toner image by the developing device 43. The toner image is transferred to a paper sheet by the transferring corona discharger 44, and toner remaining on the surface of the photosensitive drum 41 is collected by the cleaning device 45.

Disposed above the developing device 43 is a toner supply device 100 for supplying toner to the developing device 43. The toner supply device 100 includes a toner cartridge 200 which houses toner to be supplied, and a toner supply device main body 300. The toner cartridge 200 can removably be set in the toner supply device main body 300, and the toner supply device main body 300 has a rotatable guide tray 310 for guiding the toner cartridge 200 when inserted and removed.

As shown in FIG. 2, the guide tray 310 is rotatable around a predetermined axis 60. Accordingly, the guide tray 310 can assume a horizontal posture in which the guide tray 310 is being brought to the front of the copying apparatus (hereinafter referred to as guide posture), and a perpendicular posture in which the guide tray 310 stands as extending along a pulling-side end surface 205 of the set toner cartridge 200 (hereinafter referred to as retreat posture). The guide tray 310 in the guide posture can guide the toner cartridge 200 when inserted and removed. Further, the guide tray 310 in the retreat posture does not interfere with an openable cover 12 of the front side 11 of the copying apparatus main body 10.

For replacing the toner cartridge 200, the openable cover 12 forming part of the front side 11 of the copying apparatus main body 10, is opened and the guide tray 310 is thrown to the horizontal guide posture as shown in FIG. 2. Then, the used toner cartridge 200 is pulled out, and a new toner cartridge 200 is inserted. At this time, the guide tray 310 guides the removal and insertion of the used and new toner cartridges. The openable cover 12 is rotatable around a horizontal axis 13 extending along the front side 11. Thus, the inside of the copying apparatus main body 10 can be opened and closed. Upon completion of setting the toner cartridge 200, the guide tray 310 is raised to the perpendicular retreat posture where the guide tray 310 extends along the pulling-side end surface 205 of the toner cartridge 200, and the openable cover 12 is then closed as it is raised to a perpendicular posture.

There are instances where the guide tray 310 remains in the horizontal guide posture shown in FIG. 2. Even in such a case, when the openable cover 12 is closed, the openable cover 12 comes in contact with the guide tray 310 and the guide tray 310 can be raised up to the perpendicular retreat posture.

Toner Supply Device Main Body

Figure 3:
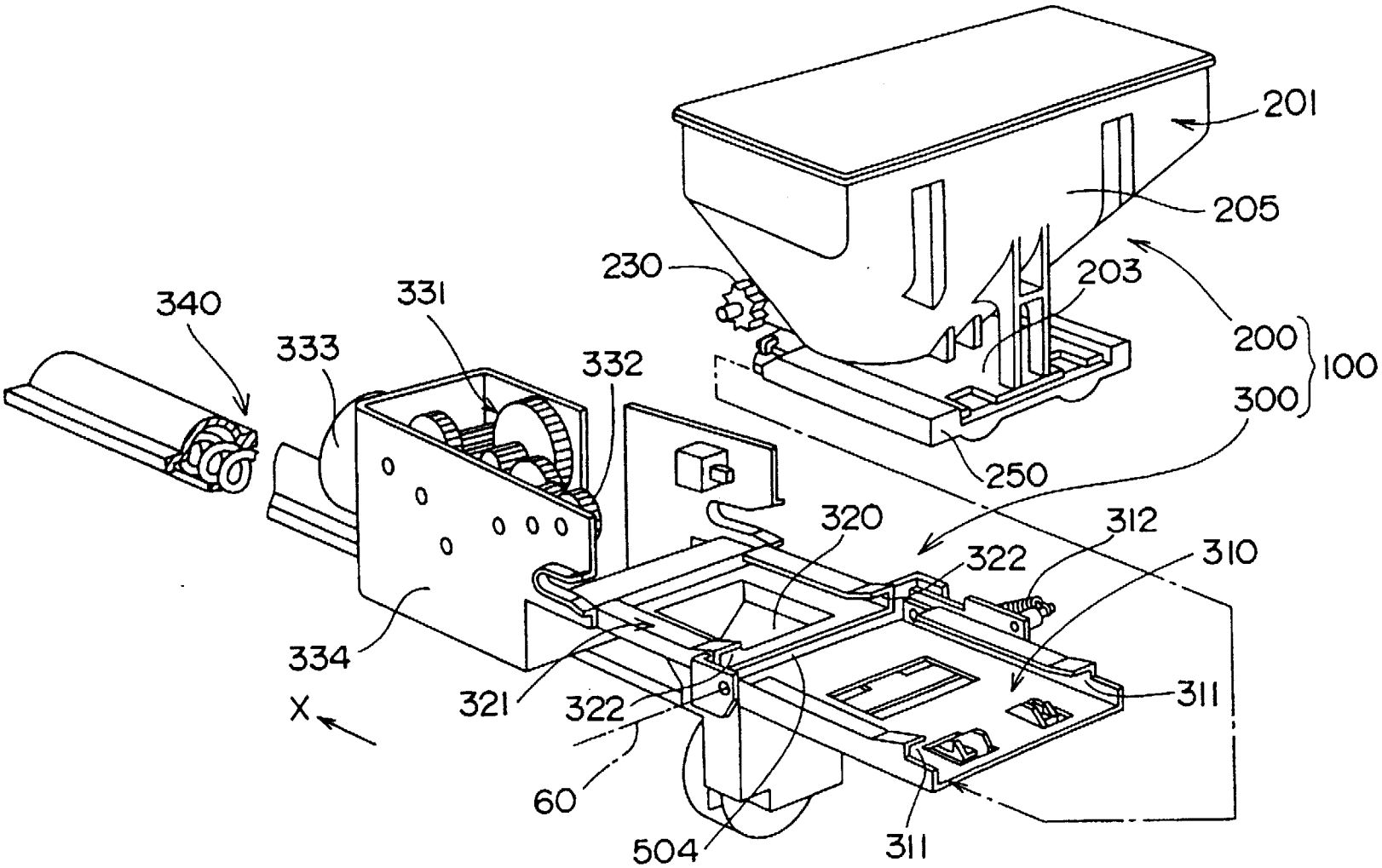
FIG. 3 is an exploded perspective view of the toner supply device shown in FIG. 1.

The following description will discuss the toner supply device main body 300 with reference to FIG. 3. In FIG. 3, an arrow X shows the insertion direction of the toner cartridge 200. The direction opposite to the X direction will be hereinafter referred to as counter-X direction. The toner supply device main body 300 includes the guide tray 310 and a tension coiled spring 312 as posture holding means for holding, according to the rotational angle of the guide tray 310, the guide tray 310 at the perpendicular retreat posture or the horizontal guide posture. The toner supply device main body 300 further includes a mounting portion 321 in which the toner cartridge 200 guided by the guide tray 310 is mounted at a predetermined setting position, a hopper portion 320 disposed under the mounting portion 321 for receiving toner which falls from the set toner cartridge 200, and a screw conveyor 340 as conveying means for conveying toner from the hopper portion 320 to the developing device 43. The toner supply device main body 300 further includes a gear mechanism 331 supported by a support member 334, and a motor 333 for rotationally driving the gear mechanism 331. The gear mechanism 331 has a driving gear 332 to be meshed with a follower gear 230 of the toner cartridge 200 set at the setting position.

At the front end (the end in the counter-X direction) of the mounting portion 321, the guide tray 310 is toggle-connected in a manner rotatable around the axis 60. The guide tray 310 is provided in both lateral sides thereof with a pair of guide grooves 311 extending in the X direction in which the toner cartridge 200 is to be inserted/removed when the guide tray 310 is in the horizontal guide posture. These grooves 311 are arranged to guide a shutter member 250, to be discussed later, of the toner cartridge 200. Further, the guide tray 310 is arranged to be engaged with the shutter member 250 such that the shutter member 250 is moved to an opening position when inserting the toner cartridge 200.

The mounting portion 321 has a pair of grooves 322 extending in the X direction in which the toner cartridge 200 is to be inserted and removed. The grooves 322 form part of guide means and are arranged to guide a flange 203, to be discussed later, of the toner cartridge 200. The mounting portion 321 is provided at the counter-X directional end thereof with a positioning contact surface 504. The positioning contact surface 504 is arranged to come in contact with the X-directional end of the shutter member 250 which is being slidably inserted on the guide tray 310. This regulates the X-directional movement of the shutter member 250 with respect to the guide tray 310.

Toner Cartridge

Figure 4:
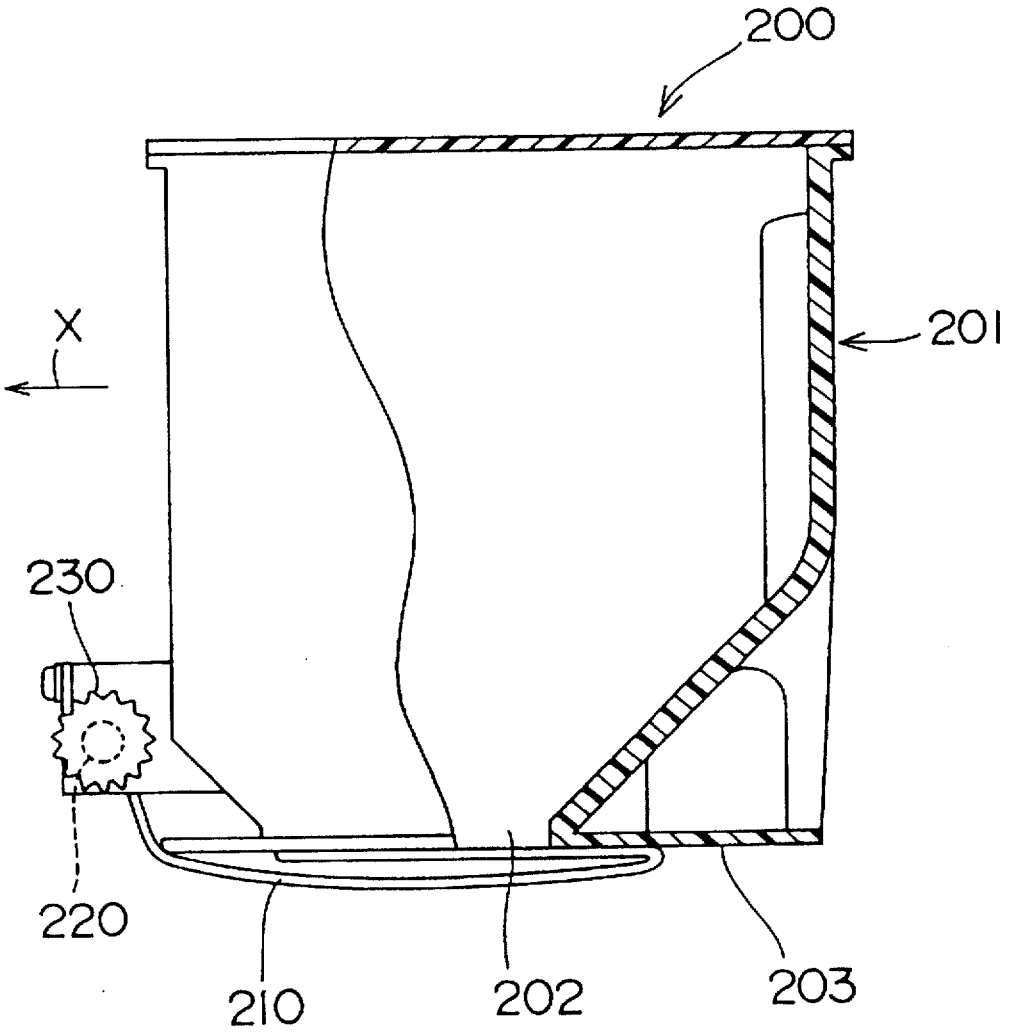
FIG. 4 is a partial section view in side elevation of the toner cartridge.
Figure 5:
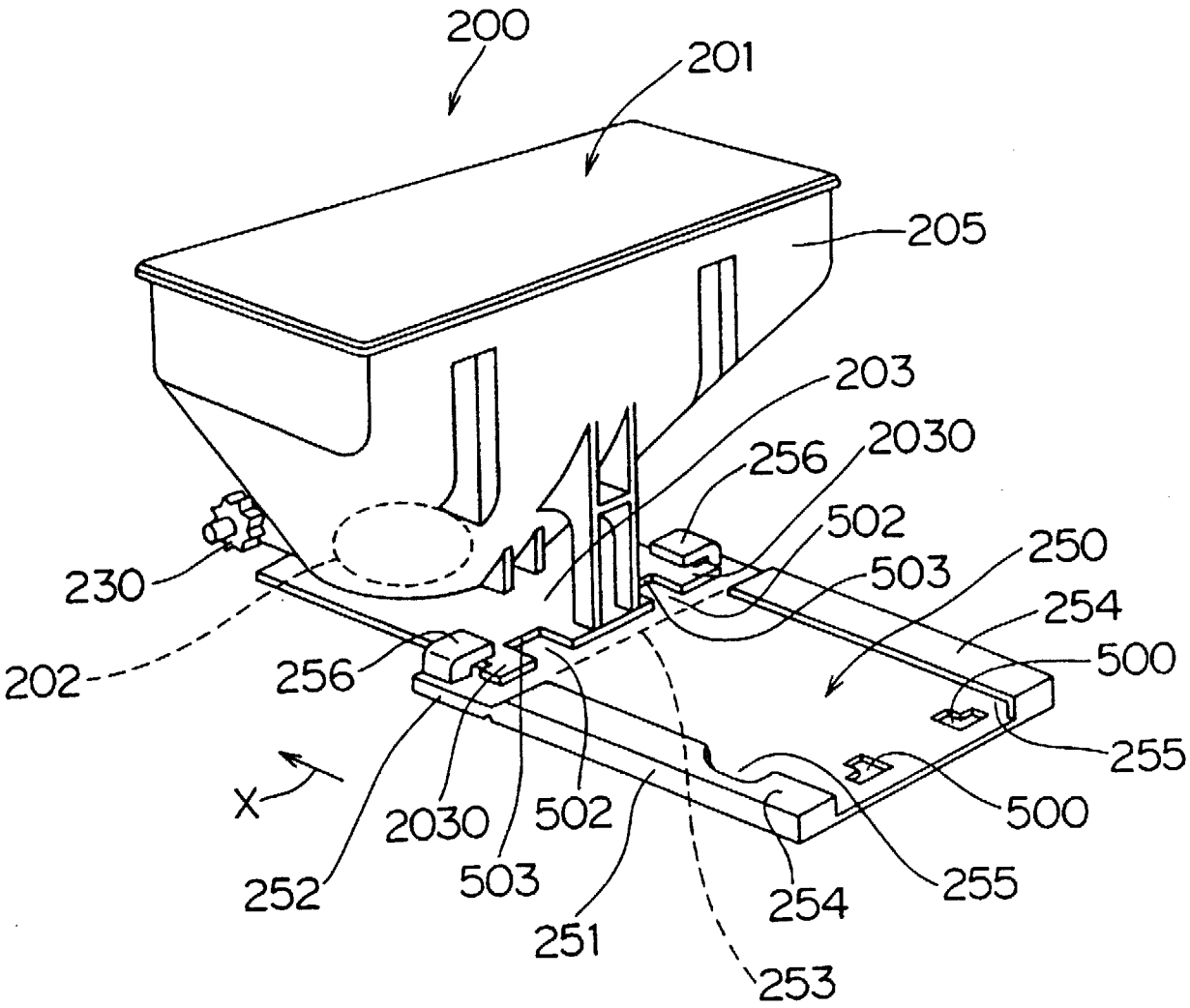
FIG. 5 is a perspective view of the toner cartridge with the shutter member opened.

The following description will discuss the toner cartridge 200 with reference to FIGS. 3 to 5. The toner cartridge 200 includes (i) a toner cartridge main body 201 made in the form of a container in which the flange 203 forming the bottom surface has a toner falling opening 202, and (ii) a film-like seal member 210 which is removably attached to the underside of the flange 203 to close the toner falling opening 202. The toner cartridge 200 further includes (i) a winding shaft 220 to which one end of the seal member 210 is fixed and on which the seal member 210 is wound while being stripped off from the flange 203, (ii) the follower gear 230 rotatable integrally with the winding shaft 220, and (iii) the shutter member 250 slidably attached to the flange 203. The shutter member 250 is so arranged as to open and close the toner falling opening 202 at a position lower than the seal member 210 when the shutter member 250 is slid. The toner cartridge 200 has the pulling-side end surface 205. The flange 203 is provided in the pulling-side end thereof with a pair of notches 502 recessed in the X direction. The innermost surfaces of the notches 502 form disengaging contact surfaces 503 to be discussed later.

Shutter Member

Figure 6:
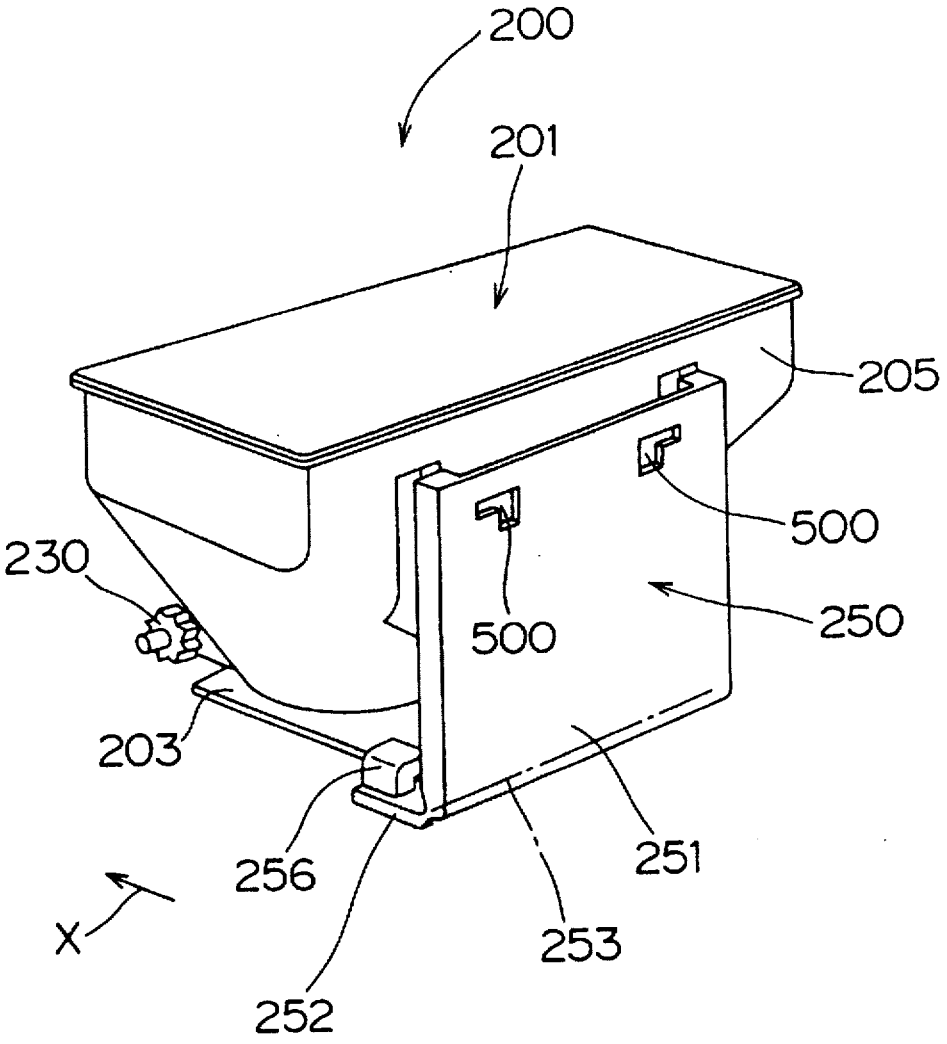
FIG. 6 is a perspective view of the toner cartridge with the shutter member retreated.

The following description will discuss the shutter member 250 with reference to FIGS. 3, 5, 6, 7. Since the shutter member 250 can slide with respect to the flange 203, the shutter member 250 is movable between a closing position at which the toner falling opening 202 is closed (See FIG. 3) and an opening position at which the toner falling opening 202 is opened (See FIG. 5). When the shutter member 250 is located in the opening position, a portion of the shutter member 250 (a first portion 251) can be rotated with respect to the remaining portion of the shutter member 250 (a second portion 252), and can assume a retreat posture in which the first portion 251 extends along the pulling-side end surface 205 of the toner cartridge 200 as shown in FIG. 6.

Figure 7:
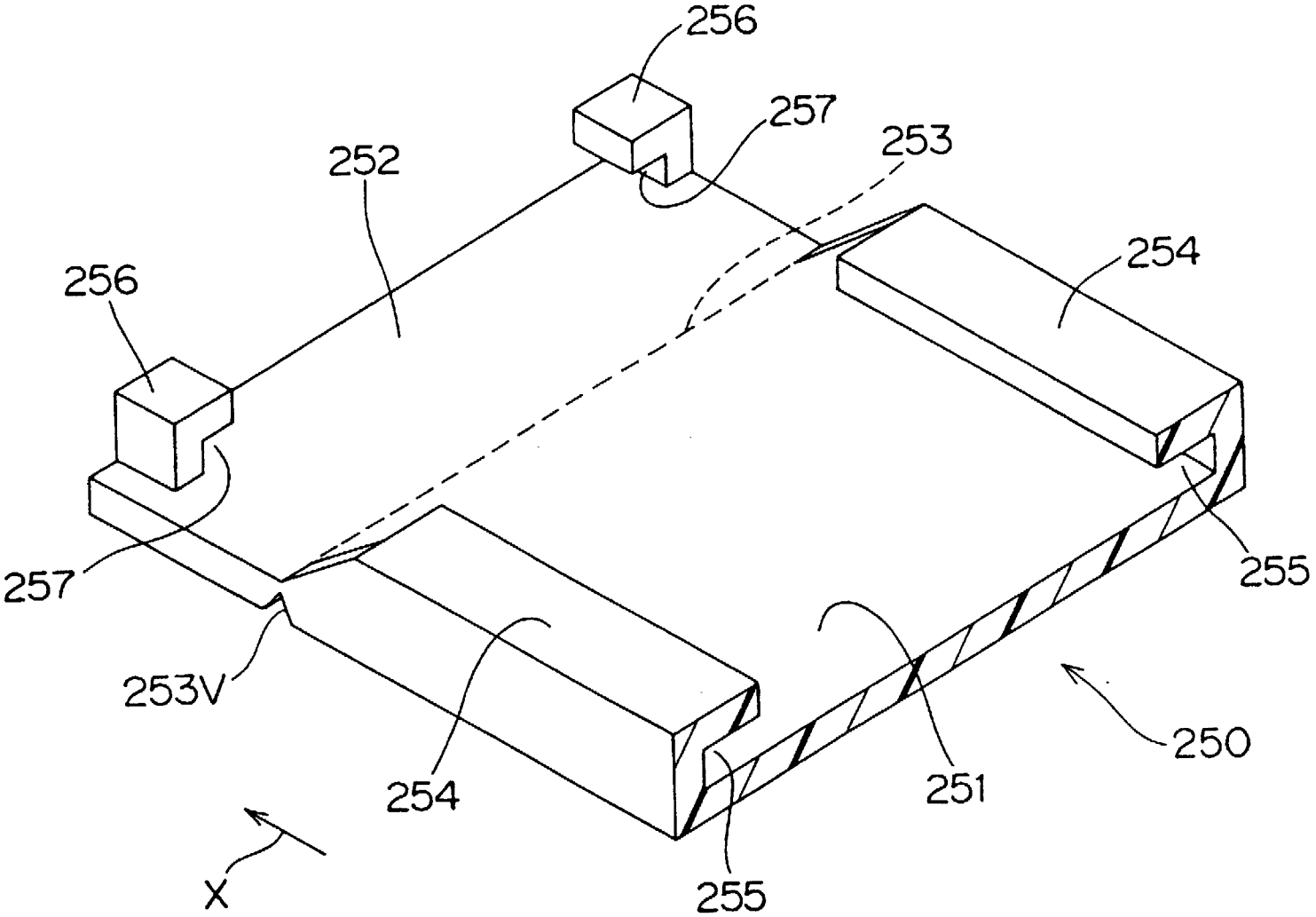
FIG. 7 is an enlarged perspective view of main portions of the shutter member.

More specifically, with reference to FIGS. 5, 6, 7, the shutter member 250 is slidable along the flange 203 and has the first portion 251 and the second portion 252 which are relatively rotatably connected to each other. These first and second portions 251 and 252 are formed of an integrally molded article of resin, and the portion which relatively rotatably connects these portions 251 and 252 to each other, is formed of a folding line portion 253 of which thickness is smaller than that of other portion. In this embodiment, a V-groove 253V is formed in the underside of the shutter member 250, and this V-groove 253V is reduced in thickness, thus forming the folding line portion 253.

The first portion 251 is provided at a pair of opposite edges thereof with long L-shape plates 254 each having a reverse L-shape section. The L-shape plates 254 have guide grooves 255 into which the corresponding edges of the flange 203 are introduced. The second portion 252 is provided at opposite edges thereof with L-shape projections 256 each having a reverse L-shape section. The L-shape projections 256 have guide grooves 257 into which the corresponding edges of the flange 203 are introduced. When the shutter member 250 is located in the opening position, these L-shape projections 256 are engaged with engagement projections (slipping-off prevention projections) 2030 of the flange 203 at the pulling-side end thereof (See FIG. 5).

When the shutter member 250 is located in the opening position shown in FIG. 5, only the first portion 251 is disconnected from the toner cartridge main body 201 and is rotatable with respect to the second portion 252. Accordingly, when the first portion 251 is rotated, the first portion 251 can assume the retreat posture in which the first portion 251 extends along the pulling-side end surface 205 of the toner cartridge main body 201.

Figure 9:
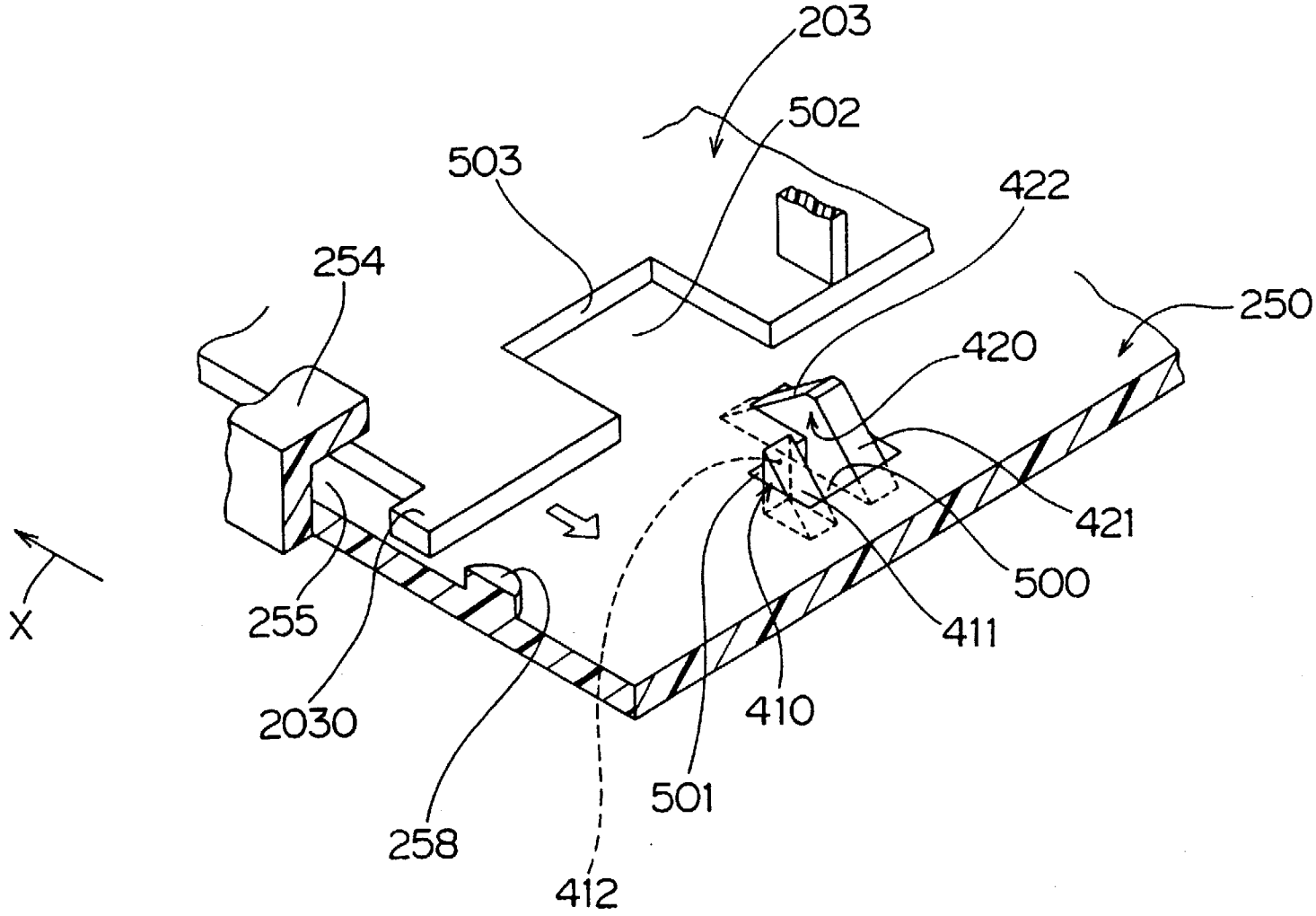
FIG. 9 is a partial sectional perspective view of main portions of the shutter member and the flange in a state while the toner cartridge is being pulled out.

As shown in FIGS. 5 and 6, the shutter member 250 is provided in the vicinity of the free end thereof with a pair of through-holes 500 formed side by side in the widthwise direction. As shown in FIG. 9, the through-holes 500 are provided at inner sides thereof with engagement surfaces 501 which are engaged with engagement surfaces 412, to be discussed later, of the guide tray 310 to regulate the counter-X directional movement of the shutter member 250 with respect to the guide tray 310.

Guide Tray and Shutter Member Engaging and Disengaging Mechanism

Figure 8:
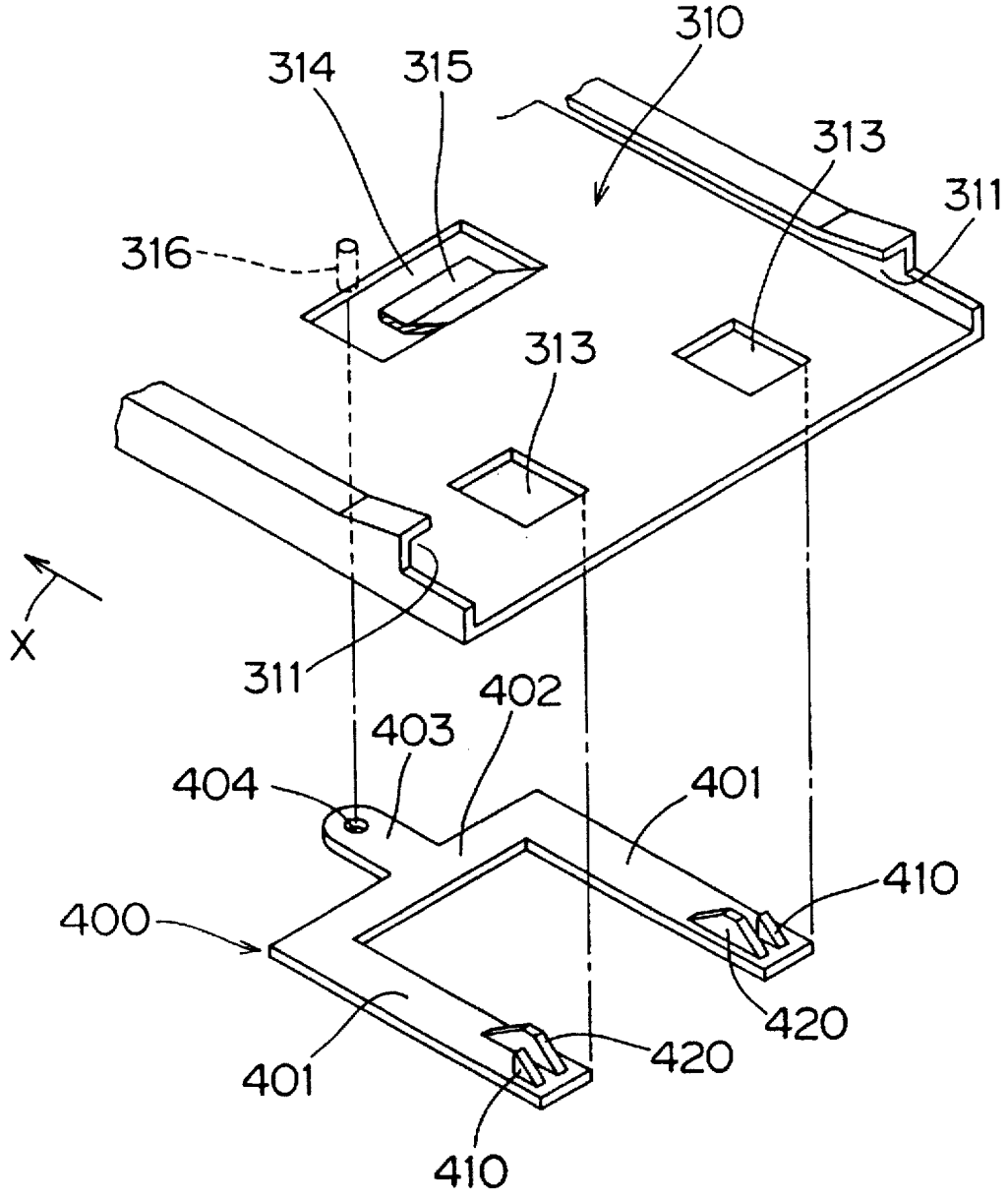
FIG. 8 is an exploded perspective view of main portions of the guide tray.
Figure 10:
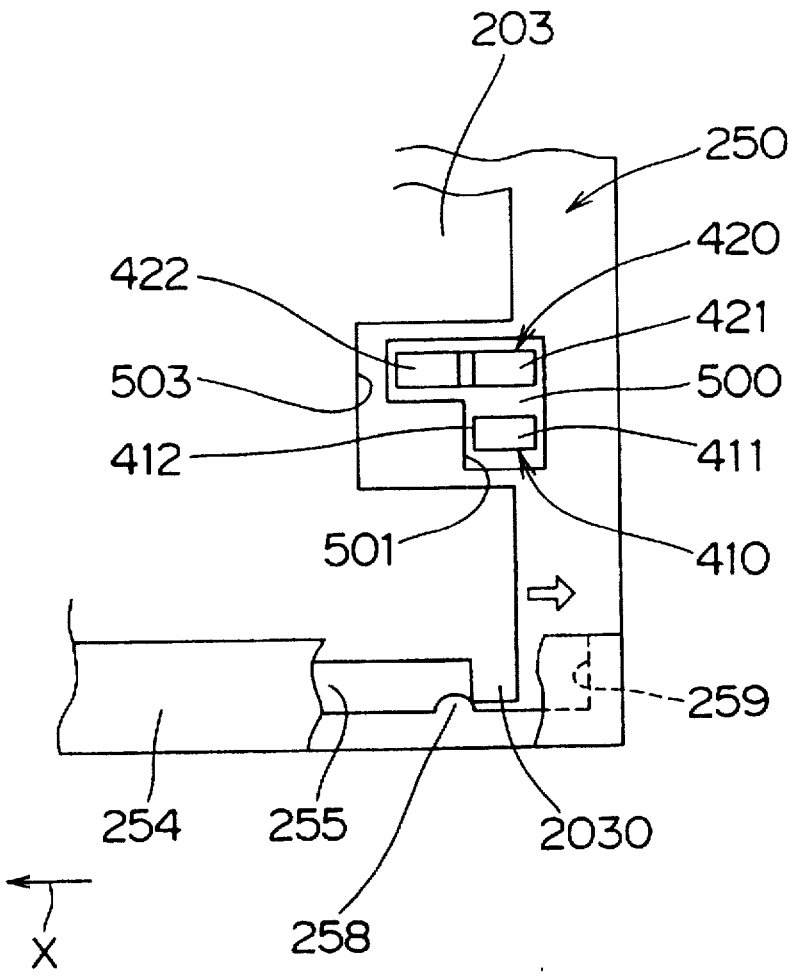
FIG. 10 is a plan view, with portions broken away, of main portions of the shutter member and the flange in a state while the toner cartridge is being pulled out.

The following description will discuss a mechanism for engaging and disengaging the guide tray 310 with and from the shutter member 250 with reference to FIGS. 8 to 10. With reference to FIG. 8, this engaging and disengaging mechanism includes a resilient support plate 400 substantially having a U-shape section, and a pair of first and second projections 410 and 420 formed at each of the ends of the resilient support plate 400.

Referring to FIG. 8, the guide tray 310 is provided in the vicinity of the pulling-side end thereof with a pair of through-holes 313. These through-holes 313 are formed with a predetermined spatial interval provided therebetween in the widthwise direction of the guide tray 310. Further, a cut-down through-hole 314 is formed in the guide tray 310 at its position which is at the center in the widthwise direction and which is separated by a predetermined distance in the X direction from the through-holes 313. Formed at the counter-X directional edge of the through-hole 314 is a cut-down piece 315 which is cut downwardly and then extends in the X direction. Further, a downwardly extending stop pin 316 is fixed to the guide tray 310 in the vicinity of the X-directional edge of the through-hole 314.

The resilient support plate 400 has a pair of parallel cantilever pieces 401, a connection piece 402 which connects the base ends of the cantilever pieces 401 to each other, and an extending piece 403 which extends from the center of the connection piece 402 in the direction opposite to the direction in which the cantilever pieces 401 extend. The extending piece 403 has an engagement hole 404 to which the stop pin 316 is fitted. With the connection piece 402 held by and between the underside of the guide tray 310 in the guide posture and the cut-down piece 315, the resilient support plate 400 is fixed to the guide tray 310 by the stop pin 316 which has passed through the engagement hole 404. In such a state, the free end portions of the cantilever pieces 401 are resiliently vertically movable.

On the other hand, each of the cantilever pieces 401 is provided in the vicinity of the free end thereof with a set of first and second projections 410 and 420. These first and second protections 410 and 420 are arranged to pass through the through-holes 313 and resiliently project above the guide tray 310.

Each of the first projections 410 is substantially in the form of a right-angled triangle in side elevation, and each of the second projections 420 is in the form of an equilateral triangle in side elevation. The counter-X directional inclined surfaces of the first and second projections 410 and 420, form introduction allowable cam surfaces 411 and 421. When the shutter member 250 of the toner cartridge 200 is introduced onto the guide tray 310, these introduction allowable cam surfaces 411 and 421 come in contact with the X-directional end of the shutter member 250 to downwardly bend the cantilever pieces 401, thus allowing the introduction of the shutter member 250.

Upon completion of the insertion of the shutter member 250 onto the guide tray 310, the perpendicular engagement surfaces 412 of the first projections 410 in the X direction side are engaged with the engagement surfaces 501 or inner surfaces of the through-holes 500 of the shutter member 250. This regulates the counter-X directional movement of the shutter member 250 with respect to the guide tray 310. That is, this prevents the shutter member 250 from being pulled out from the guide tray 310. The engagement surfaces 412 and the engagement surfaces 501 form engaging means.

The X-directional inclined surfaces of the second projections 420 form disengaging cam surfaces 422 for releasing the engagement between the engagement surfaces 412 and 501 serving as the engaging means. When the toner cartridge 200 is pulled out, the disengaging cam surfaces 422 are engaged with the disengaging contact surfaces 503 of the flange 203 to downwardly bend the cantilever pieces 401, thus releasing the engagement of the engagement surfaces 412 and 501 with each other.

Engagement projections 258 are formed inside of the guide grooves 255 in the vicinity of the pulling-side end of the shutter member 250. When the toner cartridge 200 is pulled out, the engagement projections 258 are engaged with the engagement projections 2030 of the flange 203 to regulate the shutter member 250 to the closing position with respect to the toner cartridge main body 201. More specifically, the engagement projections 2030 of the flange 203 are displaced as riding across the engagement projections 258 of the shutter member 250 regulated by the engagement of the engagement surfaces 412 and 501, and then engaged with the engagement projections 258. These engagement projections 258 and 2030 form shutter position regulating means. The counter-X directional movement of the shutter member 250 with respect to the toner cartridge main body 201, is regulated by the engagement between the engagement projections 258 and 2030. The X-directional movement of the shutter member 250 with respect to the toner cartridge main body 201 is regulated by the engagement of counter-X directional end surfaces 259 in the guide grooves 255 of the shutter member 250 with the engagement projections 2030 of the flange 203. The end surfaces 259 form part of the shutter position regulating means.

The positional relationship between the shutter position regulating means and the disengaging means is set such that, while the toner cartridge 200 is being pulled out, the timing of engagement between the engagement projections 258 and 2030 serving as the shutter position regulating means is prior to the timing of engagement between the disengaging cam surfaces 422 and the disengaging contact surfaces 503 serving as the disengaging means. That is, in the course of pulling the toner cartridge 200, immediately after the engagement between the engagement projections 258 and 2030, the disengaging cam surfaces 422 are not being engaged yet with the disengaging contact surfaces 503, as shown in FIG. 10.

Operation

With reference to FIGS. 11 to 14, the following description will discuss the operation of inserting and removing the toner cartridge 200 into and from the toner supply device main body 300.

Figure 11:
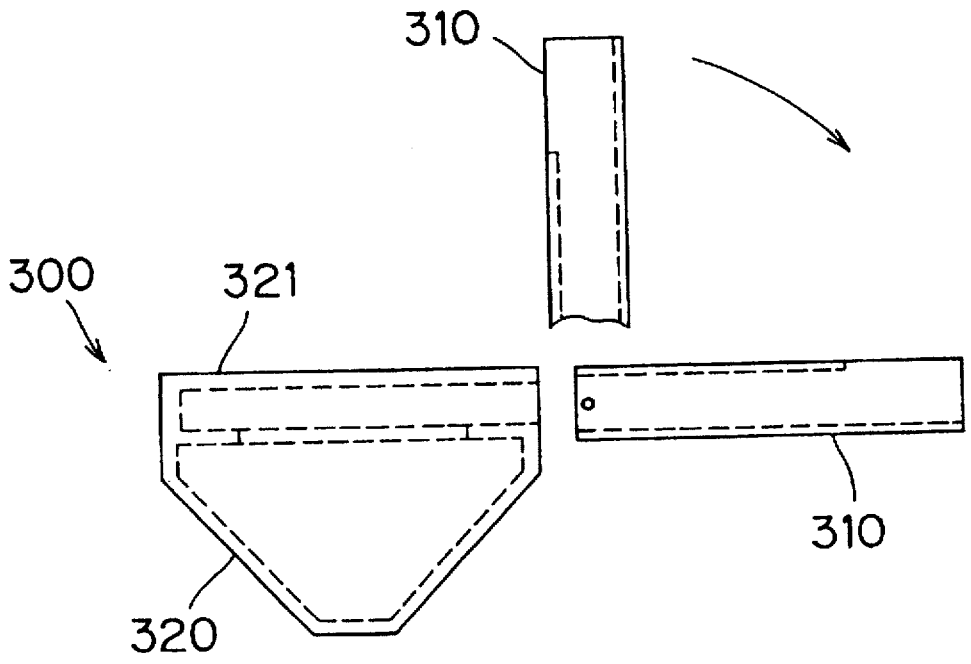
FIG. 11 is a schematic side view of the toner supply device main body illustrating a state where the guide tray is brought down from a perpendicular retreat position to a horizontal guide position.

1) As shown in FIG. 11, the standing guide tray 310 is first brought down to the horizontal guide posture.

Figure 12:
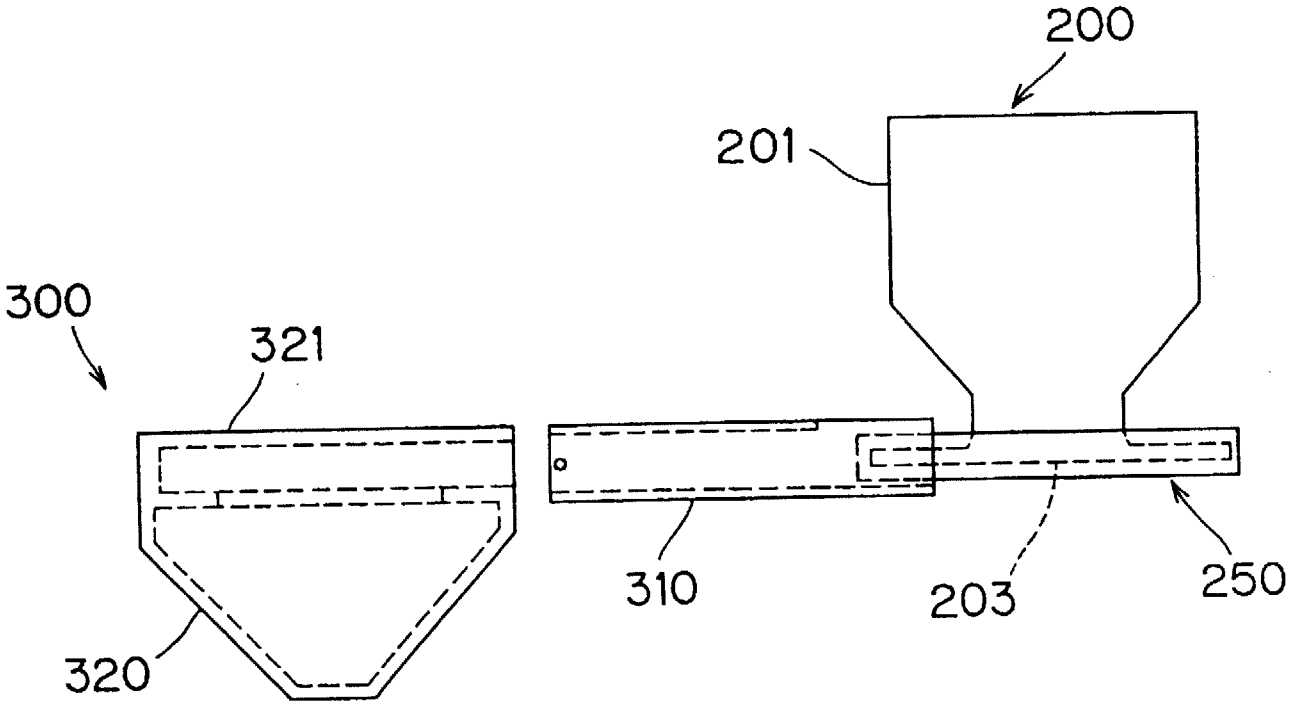
FIG. 12 is a schematic side view of the toner supply device illustrating a state where the shutter member of the toner cartridge starts being guided to the guide tray.

2) As shown in FIG. 12, a new toner cartridge 200 is set such that its shutter member 250 at the closing position is introduced into the grooves 311 of the guide tray 310 in the horizontal guide posture, and this new toner cartridge 200 is pushed in while being slid on the guide tray 310 in the X direction.

3) When the whole shutter member 250 is held by the guide tray 310, the shutter member 250 is engaged therewith, thus preventing the shutter member 250 from being moved in the X and counter-X directions with respect to the guide tray 310. The X directional movement is prevented by the positioning contact surface 504 of the mounting portion 321, and the counter-X directional movement is prevented by the engagement between the engagement surfaces 412 and 501 serving as the engaging means.

Figure 13:
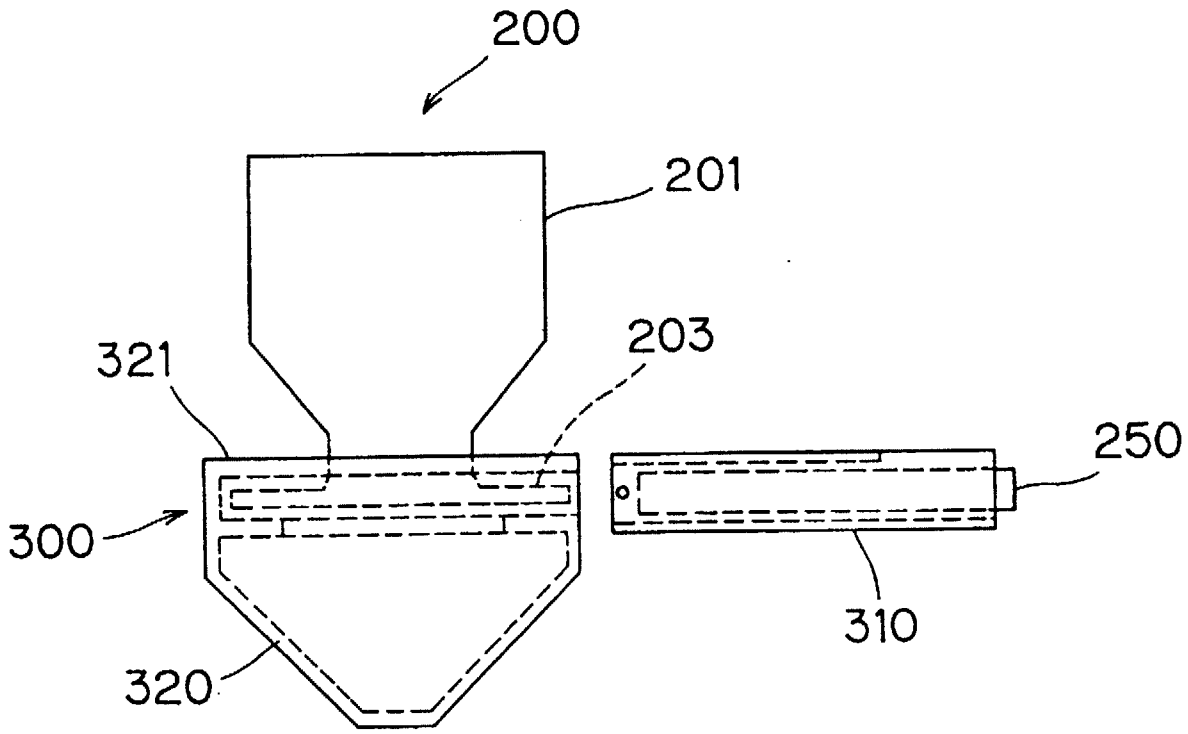
FIG. 13 is a schematic side view of the toner supply device illustrating a state where setting the toner cartridge has been finished.

4) In the state where the shutter member 250 is prevented from being moved, the toner cartridge main body 201 is further pushed in the X direction. Then, the toner cartridge main body 201 is moved on the mounting portion 321 while the flange 203 is introduced into and guided by the grooves 322 of the mounting portion 321. As shown in FIG. 13, the toner cartridge main body 201 is set on the mounting portion 321 at its predetermined setting position, and the shutter member 250 remains on the guide tray 310. More specifically, the shutter member 250 is relatively displaced to the opening position with respect to the toner cartridge main body 201.

Figure 14:
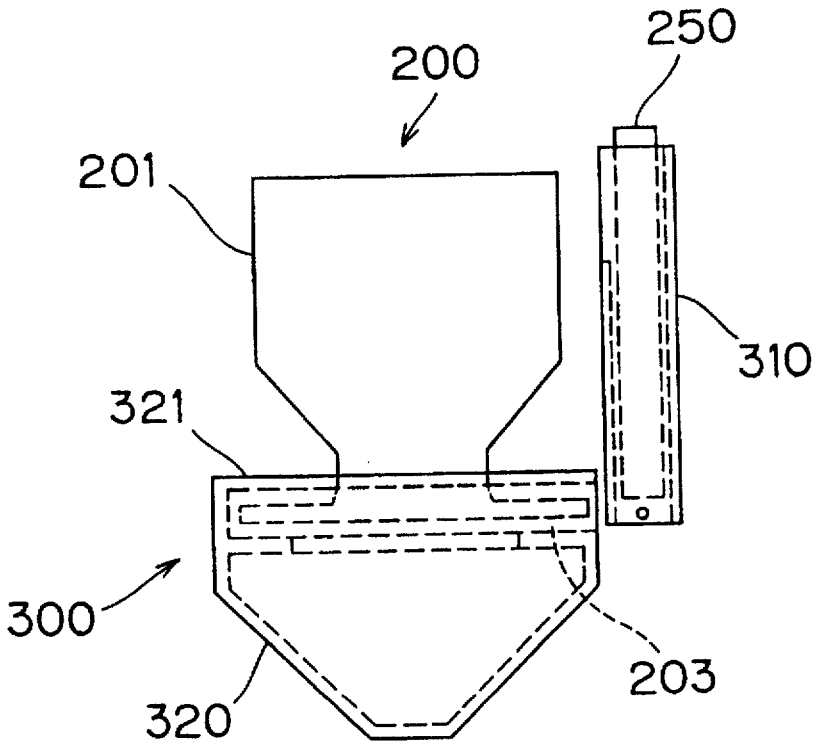
FIG. 14 is a schematic side view of the toner supply device illustrating a state where both the guide tray and the shutter member have been integrally retreated after setting the toner cartridge has been finished.
Figure 15:
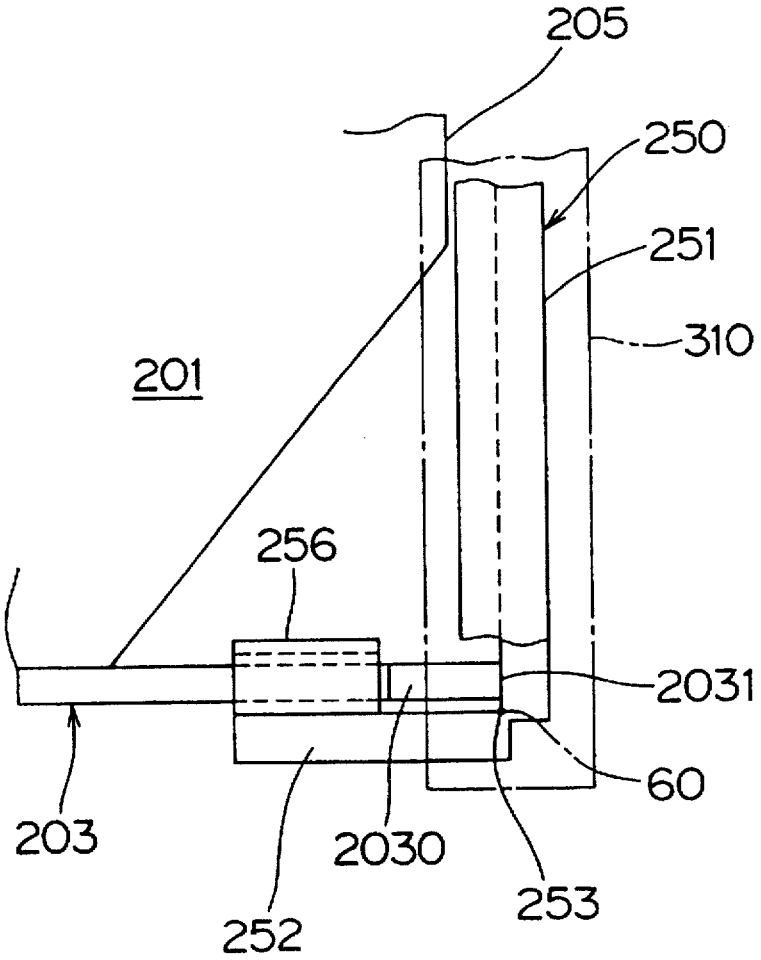
FIG. 15 is an enlarged side view, with portions broken away, of main portions of the toner supply device with both the guide tray and the shutter member retreated to the retreat posture.

5) At the setting position above-mentioned, the rotational axis 60 of the guide tray 310 is substantially identical with the folding line portion 253 serving as the rotational axis of the shutter member 250. This enables both the shutter member 250 and the guide tray 310 to be integrally rotated. Thus, as shown in FIG. 14, both the shutter member 250 and the guide tray 310 which holds the same, are raised up as integrally rotated, and retreated to the retreat posture. In this retreat posture, the standing first portion 251 of the shutter member 250 comes in contact with the pulling-side end 2031 of the flange 203 of the toner cartridge main body 201, and the tension coiled spring 312 exerts a biasing force such that the retreat postures of the guide tray 310 and the shutter member 250 are maintained, as shown in detail in FIG. 15. This prevents the toner cartridge main body 201 as positioned at the setting position from being pulled out therefrom.

If the toner cartridge main body 201 is not being properly set to the setting position, the rotational axis 60 of the guide tray 310 is positionally shifted from the folding line portion 253 of the shutter member 250. Thus, the guide tray 310 cannot be rotated. This informs the operator that the toner cartridge 200 has not properly been set to the setting position.

6) When pulling the toner cartridge 200, the order of the steps above-mentioned shown in FIG. 11 to FIG. 14 is reversed. In the course of pulling the toner cartridge 200 from the state in FIG. 13 to the state in FIG. 12, the shutter member 250 is disengaged from the guide tray 310 after the shutter member 250 has been locked to the closing position with respect to the toner cartridge main body 201 (See FIGS. 9 and 10).

According to the embodiment above-mentioned, the toner cartridge 200 can be pulled out only after the toner falling opening 202 has fully been closed by the shutter member 250. This securely prevents toner remaining inside of the toner cartridge 200 from scattering when the toner cartridge 200 is pulled out.

Further, the guide tray 310 can guide the insertion and removal of the toner cartridge 200. This enables the toner cartridge 200 to be smoothly inserted and removed, thus facilitating the replacement of the toner cartridge 200. Further, the shutter member 250 can be held by the guide tray 310. It is therefore not required to support the shutter member 250 with hand. This further facilitates the replacement of the toner cartridge 200. Further, when unnecessary, the guide tray 310 can be retreated and therefore gets out of the way without a large space being occupied.

Further, the guide tray 310 is required to be operated whenever the toner cartridge 200 is pulled out. This prevents the toner cartridge 200 from being carelessly pulled out to cause toner to scatter. Further, the guide tray 310 also serves as a member for preventing the toner cartridge 200 from being pulled out. This simplifies the structure as compared with an arrangement in which the pulling-out preventing member is provided independently from the guide tray 310.

Further, when the toner cartridge 200 is set to the setting position, both the guide tray 310 and the shutter member 250 can integrally be retreated, thus further improving the maneuverability of replacing the toner cartridge 200. On the other hand, when the toner cartridge 200 is positionally shifted from the setting position, both the guide tray 310 and the shutter member 250 cannot integrally be rotated to the retreat postures. This prevents toner from scattering due to defective mounting of the toner cartridge 200.

Further, according to the embodiment above-mentioned, the shutter member 250 which is not under use, is being connected to the toner cartridge main body 201. This eliminates not only the labor of searching for the shutter member 250 when it becomes necessary, but also the operation of positioning the shutter member 250 with respect to the toner cartridge main body 201. This facilitates the maintenance operation. Further, the shutter member 250 which is not under use, is retreated to the retreat posture in which the shutter member 250 gets out of the way outside of the toner cartridge main body 201. Thus, there can be achieved a small-size toner cartridge having a simple structure as compared with a double-container structure of prior art, and the toner cartridge 200 when mounted, does not occupy an unnecessarily large space.

Further, as shown in FIG. 6, the second portion 252 of the shutter member 250 is slidably connected to the flange 203 of the toner cartridge main body 201 with the first portion 251 retreated. Accordingly, when the second portion 252 is slid, the first portion 251 can readily be guided such that the first portion 251 is located along the underside of the flange 203 of the toner cartridge main body 201.

In addition, the first and second portions 251 and 252 of the shutter member 250 and the portion for relatively rotatably connecting these portions 251 and 252 to each other, are integrally molded from resin. Such a structure can considerably be lowered in production cost as compared with a structure in which the first and second portions 251 and 252 are individually made and then connected to each other by a pin or the like.

In the embodiment above-mentioned, the shutter member 250 is rotationally retreated to the retreat posture where the shutter member 250 extends along the pulling-side end surface 205 of the toner cartridge main body 201. However, there may be disposed a shutter member having a number of parallel folding lines such that the shutter member can resiliently be bent in its entirety and slidably be retreated to a retreat posture.

The present invention is not limited to the embodiment above-mentioned, but can also be applied to an arrangement in which the guide tray 310 is eliminated. In such a case, the engaging means and the disengaging means of the guide tray 310 in the embodiment above-mentioned are disposed at other portions of the toner supply device main body 300 than the guide tray 310. Further, the guide tray 310 may guide members other than the shutter member 250.

An embodiment of the present invention has been discussed in detail. However, the foregoing embodiment is a mere illustrative example for disclosing the technical nature of the present invention, and the present invention should not be interpreted in a narrow sense of meaning by limiting to this practical example only. Hence, the true spirit and scope of the present invention should be limited only by the description of the accompanying claims.

What is claimed is:

1. A toner supply device for use with a toner cartridge that includes a toner cartridge main body in which toner is housed and which is provided in an underside thereof with a toner falling opening, and a plate-like shutter member disposed as extending along the underside of the toner cartridge main body and slidable between a closing position where the toner falling opening is closed, and an opening position where the toner falling opening is opened, the toner supply device comprising:

a toner supply device main body capable of setting the toner cartridge to a predetermined setting position therein, and guide means disposed at the toner supply device main body for guiding the toner cartridge along a predetermined insertion direction when inserting and pulling the toner cartridge into and from the setting position; and wherein:

the guide means includes a guide tray capable of assuming a guide posture for guiding insertion and removal of the toner cartridge, and a retreat posture in which the guide tray is retreated to a predetermined retreated position, the guide tray has engaging means for coming in engagement with the shutter member at a predetermined portion thereof to prevent the shutter member from coming off from the guide tray, the shutter member of the toner cartridge is provided in the vicinity of an end thereof in a counter-insertion direction with an engagement surface, the engaging means includes a first projection and a resilient support member for resiliently biasing the first projection toward an engagement position where the first projection is engaged with the engagement surface, and the disengaging means includes a second projection having a cam surface arranged to be engaged with a predetermined portion of the toner cartridge main body in a course of pulling out, and is arranged to deform the resilient support member such that an engagement of the first projection with the engagement surface is released.

2. A toner supply device according to claim 1, wherein:

the guide tray is rotatable around a predetermined axis, and assumes the guide posture and the retreat posture by a rotation thereof around the predetermined axis.

3. A toner supply device according to claim 1, further comprising:

posture holding means for holding, at the guide posture, the guide tray which is in the guide posture.

4. A toner supply device according to claim 1, further comprising:

posture holding means for holding, at the retreat posture, the guide tray which is in the retreat posture.

5. A toner supply device according to claim 1, wherein:

the guide tray in the retreat posture is engageable with a predetermined portion of the toner cartridge to regulate the toner cartridge at the setting position and prevent the toner cartridge from being pulled out.

6. A toner supply device according to claim 1, wherein:

the shutter member of the toner cartridge is connected to the toner cartridge main body such that the shutter member at the opening position is rotatable around a predetermined rotational axis and retreatable to a retreat posture where the shutter member extends along a pulling-side end surface of the toner cartridge main body; and the guide tray is rotatable between the guide posture and the retreated posture around a predetermined axis which is substantially identical with the rotational axis of the shutter member being at the setting position.

7. A toner supply device according to claim 1, further comprising:

positioning means for regulating, when the toner cartridge is inserted toward the setting position, a displacement of the shutter member in the insertion direction to position the shutter member at a predetermined position such that the shutter member is slid to the opening position with respect to the toner cartridge main body.

8. A toner supply device according to claim 1, further comprising:

disengaging means for releasing, when the toner cartridge is pulled out from the setting position, the engagement of the engaging means after the shutter member has closed the underside of the toner cartridge main body.

9. A toner supply device according to claim 8, wherein:

the toner cartridge includes shutter position regulating means for regulating the shutter member to the closing position; and the disengaging means is arranged such that, when the toner cartridge is pulled out from the setting position, the engagement of the engaging means with the shutter member is released after the shutter member has been regulated to the closing position by the shutter position regulating means.

10. A toner supply device for use with a toner cartridge including (i) a toner cartridge main body in which toner is housed and which is provided in an underside thereof with a toner falling opening, and (ii) a plate-like shutter member disposed as extending along the underside of the toner cartridge main body and slidable between a closing position where the toner falling opening is closed, and an opening position where the toner falling opening is opened, the toner supply device comprising:

a toner supply device main body capable of removably setting the toner cartridge to a predetermined setting position therein, guide means disposed at the toner supply device main body for guiding the toner cartridge along a predetermined insertion direction when inserting and pulling the toner cartridge into and from the setting position, engaging means, respectively disposed at the toner supply device main body and the shutter member and engageable with each other when the toner cartridge is inserted, for regulating a movement of the shutter member in a counter-insertion direction with respect to the toner supply device main body, disengaging means, respectively disposed at the toner supply device main body and the toner cartridge main body, for releasing, when the toner cartridge is pulled out, engagement of the engaging means after the shutter member has closed the toner falling opening, shutter position regulating means for regulating the shutter member to the closing position when the toner cartridge is pulled out, and a positional relationship between the disengaging means and the shutter position regulating means being determined such that, when the toner cartridge is pulled out, the shutter position regulating means are engaged with one another before the disengaging means release the engagment of the engaging means.

11. A toner cartridge removably settable along a predetermined insertion direction to a predetermined setting position of a toner supply device main body, the toner cartridge comprising:

a toner cartridge main body in which toner is housed and which is provided in an underside thereof with a toner falling opening:

a film-like seal member removable attached to the underside of the toner cartridge main body for closing the toner falling opening;

a shutter member slidable, along the underside of the toner cartridge main body, between a closing position where the toner falling opening is closed at a position lower than the seal member, and an opening position where the toner falling opening is opened;

engaging means, disposed at the shutter member, for coming in engagement, when the toner cartridge is inserted toward the setting position of the toner supply device main body, with a predetermined portion of the toner supply device main body, thereby regulating a movement of the shutter member in a counter-insertion direction with respect to the toner supply device main body;

disengaging means, disposed at the toner cartridge main body, for releasing, when the toner cartridge is pulled out from the setting position of the toner supply device main body, the engagement of the engagement means with the predetermined portion of the toner supply device main body after the shutter member has been guided to the closing position; and shutter position regulating means, respectively disposed at the toner cartridge main body and the shutter member, for coming in mutual engagement when the toner cartridge is pulled out, thereby regulating the shutter member to the closing position, wherein a positional relationship between the disengaging means and the shutter position regulating means is determined such that, when the toner cartridge is pulled out, the shutter position regulating means are engaged with one another before the disengaging means releases the engagement of the engaging means.

12. A toner cartridge according to claim 11, wherein:

the shutter member is connected to the toner cartridge main body such that at least a portion of the shutter member at the opening position is retreatable in a retreat posture where the portion extends along a pulling-side end surface of the toner cartridge main body.

13. A toner cartridge according to claim 11, wherein:

the shutter member has a first portion and a second portion which are slidable along the underside of the toner cartridge main body and which are relatively rotatably connected to each other; and when the shutter member is located in the opening position, the first portion is disconnected from the toner cartridge main body and is rotatable with respect to the second portion to be retreated to a posture where the first portion extends along a pulling-side end surface of the toner cartridge main body, while the second portion is connected to the toner cartridge main body.

14. A toner cartridge according to claim 13, wherein:

the first portion and the second portion are formed of an integrally molded article of resin, and a portion which relatively rotatably connects the first and second portions to each other is formed of a folding line portion of which thickness is smaller than that of a remaining portion of the article.

15. A toner supply device for use with a toner cartridge that includes a toner cartridge main body in which toner is housed and which is provided in an underside thereof with a toner falling opening, and a plate-like shutter member disposed as extending along the underside of the toner cartridge main body and slidable between a closing position where the toner falling opening is closed, and an opening position where the toner falling opening is opened, the toner supply device comprising:

a toner supply device main body capable of setting the toner cartridge to a predetermined setting position therein; and guide means disposed at the toner supply device main body for guiding the toner cartridge along a predetermined insertion direction when inserting and pulling the toner cartridge into and from the setting position, and wherein the guide means includes a guide tray capable of assuming a guide posture for guiding insertion and removal of the toner cartridge, and a retreat posture in which the guide tray is retreated to a predetermined retreated position, the guide tray has engaging means for coming in engagement with the shutter member at a predetermined portion thereof to prevent the shutter member from coming off from the guide tray, disengaging means releases, when the toner cartridge is pulled out from the setting position, the engagement of the engaging means after the shutter member has closed the underside of the toner cartridge main body, the toner cartridge includes shutter position regulating means for regulating the shutter member to the closing position, and the disengaging means is arranged such that, when the toner cartridge is pulled out from the setting position, the engagement of the engaging means with the shutter member is released after the shutter member has been regulated to the closing position by the shutter position regulating means.

16. A toner supply device according to claim 15, wherein:

the guide tray is rotatable around a predetermined axis, and assumes the guide posture and the retreat posture by a rotation thereof around the predetermined axis.

17. A toner supply device according to claim 15, further comprising:

posture holding means for holding, at the guide posture, the guide tray which is in the guide posture.

18. A toner supply device according to claim 15, further comprising:

posture holding means for holding, at the retreat posture, the guide tray which is in the retreat posture.

19. A toner supply device according to claim 15, wherein:

the guide tray in the retreat posture is engageable with a predetermined portion of the toner cartridge to regulate the toner cartridge at the setting position and prevent the toner cartridge from being pulled out.

20. A toner supply device according to claim 15, wherein:

the shutter member of the toner cartridge is connected to the toner cartridge main body such that the shutter member at the opening position is rotatable around a predetermined rotational axis and retreatable to a retreat posture where the shutter member extends along a pulling-side end surface of the toner cartridge main body; and the guide tray is rotatable between the guide posture and the retreated posture around a predetermined axis which is substantially identical with the rotational axis of the shutter member being at the setting position.

21. A toner supply device according to claim 15, further comprising:

positioning means for regulating, when the toner cartridge is inserted toward the setting position, a displacement of the shutter member in the insertion direction to position the shutter member at a predetermined position such that the shutter member is slid to the opening position with respect to the toner cartridge main body.

* * * * *